United States Patent [19]

Knudsen

[11] Patent Number: 4,988,322

[45] Date of Patent: Jan. 29, 1991

[54] TOY BUILDING SET FOR BUILDING TREE-LIKE MODELS

[75] Inventor: Jens N. Knudsen, Billund, Denmark

[73] Assignee: Interlego A.G., Baar, Switzerland

[21] Appl. No.: 125,185

[22] Filed: Nov. 25, 1987

[30] Foreign Application Priority Data

Nov. 26, 1986 [DK] Denmark ..... 5680/86

[51] Int. Cl.[5] ..... A63H 33/06

[52] U.S. Cl. ..... 446/120

[58] Field of Search ..... 446/69, 104, 118, 119, 446/120, 121, 122, 123, 124, 125, 126, 127

[56] References Cited

U.S. PATENT DOCUMENTS

| | | | |
|---|---|---|---|
| Re. 32,663 | 5/1988 | Atkinson | 446/124 X |
| 3,442,044 | 5/1969 | Quercetti | 446/118 X |
| 3,589,056 | 6/1971 | Glass et al. | 446/118 X |
| 3,597,874 | 8/1971 | Ogsbury et al. | 446/125 X |
| 3,940,877 | 3/1976 | Culkin | 446/124 |
| 4,071,244 | 1/1978 | Richards | 446/120 X |
| 4,164,091 | 8/1979 | Lin | 446/128 X |
| 4,606,732 | 8/1986 | Lyman | 446/120 |

FOREIGN PATENT DOCUMENTS

| | | | |
|---|---|---|---|
| 702336 | 1/1965 | United Kingdom | 446/120 |

*Primary Examiner*—Robert A. Hafer

*Attorney, Agent, or Firm*—Kane, Dalsimer, Sullivan Kurucz, Levy, Eisele and Richard

[57] ABSTRACT

A toy building set for building tree-like models and comprising partly a trunk element (FIG. 2), partly a branch element. The trunk element comprises a trunk portion (2) and projecting branches (3, 4) having coupling means (5, 6) spaced from the trunk portion (2). The branch element comprises a plurality of connecting bars (7–11), at whose ends coupling bushings (12) are provided. These bushings are formed with primary and secondary coupling means (17, 18), respectively, so that the branch elements may be interconnected and connected with the trunk elements. Preferably, said bars have additional branching portions (19, 20) whose ends are provided with bushings (21, 22) similar to the coupling bushings (12).

4 Claims, 2 Drawing Sheets

TOY BUILDING SET FOR BUILDING TREE-LIKE MODELS

The invention concerns a toy building set for building treelike models, e.g. of the type known from the U.S. Pat. No. 4,164,091, and comprising elements having primary and secondary coupling means adapted for interconnection.

This known building set comprises some trunk portions and a plurality of leaf-like plates which can be coupled between the trunk portions.

The object of the invention is to provide a building set of the above-mentioned type which is considerably more flexible and allows more compact building of a tree-like model.

This is obtained in that the building set includes the elements stated in the characterizing portion of claim 1, which partly comprise some trunk elements with a plurality of coupling means spaced from the coupling means on the opposed ends of the trunk element, and partly comprise a plurality of branch elements each of which has a plurality of coupling means allowing the branch elements to be interconnected in many different ways.

Preferably, the coupling means are constructed as stated in claim 2, and the branch elements are plane in a preferred embodiment, as stated in claim 3. When the length of said bushings is slightly greater than the thickness of the rest of the branch element, several branch elements may be interconnected on top of each other with a relatively small mutual distance.

The additional branching portions mentioned in claim 4 results in a greater visual similarity between the branch element of the invention and an ordinary branch or leaf structure, and when the ends of the additional branching portions are provided with bushings which resemble the abovementioned coupling bushings, the coupling bushings are camouflaged so that the branch element as a whole has a great similarity to branches or leaves, while providing many mutual coupling possibilities.

Figure 2:
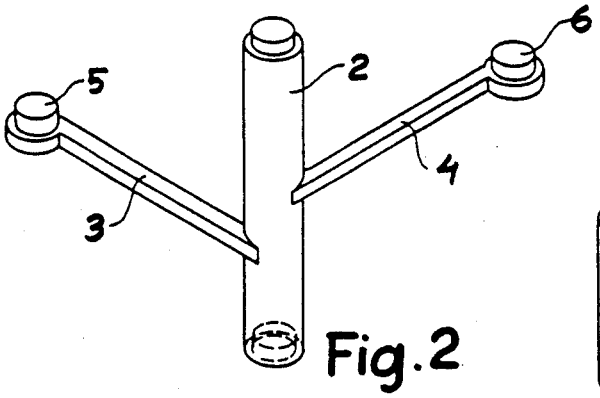
Figure 1:
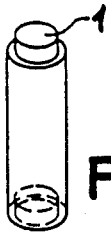
Figure 3:
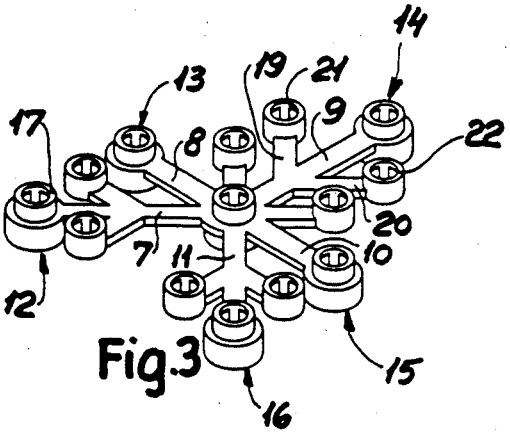
Figure 4:
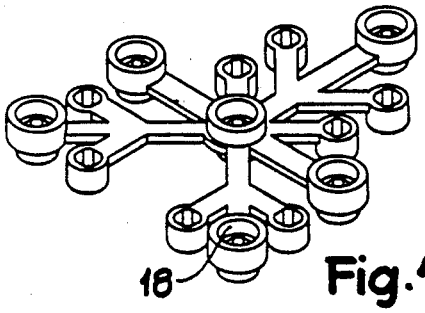
Figure 5:
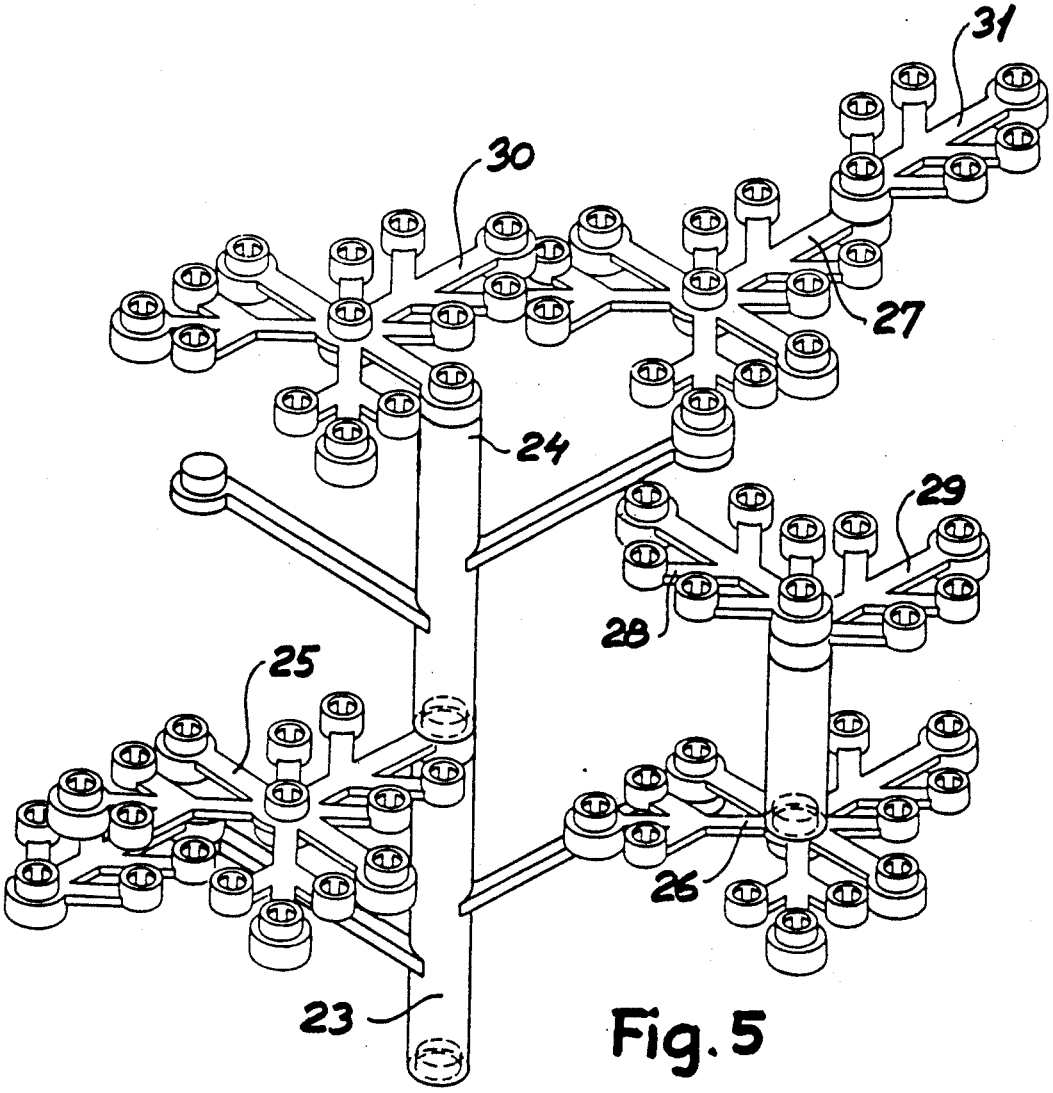

The invention will be explained more fully by the following description of an embodiment with reference to the drawing, in which FIG. 1 shows a building element known per se, which may serve as a trunk element for the invention, FIG. 2 shows a preferred trunk element belonging to the building set of the invention, FIGS. 3 and 4 are perspective top and bottom views, respectively, of a preferred embodiment of a branch element, while FIG. 5 is a schematic view of a model of a tree-like structure built by means of the building set of the invention.

FIG. 1 shows a building element which is known per se and which is also useful in connection with the building set of the invention. This element is elongate, and its ends are formed with a coupling stud 1 and a recess to receive a coupling stud from an adjacent element, respectively.

The building element shown in FIG. 2 comprises a trunk portion 2 like the one shown in FIG. 1, said trunk portion being provided with some obliquely projecting branches 3, 4, whose ends are formed with coupling studs 5, 6 of the above-mentioned type. It will be appreciated that the projecting branches might also be provided with complementary coupling means corresponding to a recess in the bottom of the trunk portion 2, cf. the explanation of FIG. 1. FIGS. 3 and 4 show a preferred embodiment for the building set of the invention. The explanation will mainly be given with reference to FIG. 3, as FIG. 4 shows the same as FIG. 3, seen from below. The branch element comprises a plurality of bars 7–11, whose ends are formed with both a primary and a secondary coupling means in the form of a coupling bushing 12–16. The axis of the bushings is perpendicular to a common plane for the bars 7–11 and has at one end 17 a coupling stud with an outside diameter which corresponds to the inside diameter of the opposite end 18 (FIG. 4). Since the length of the bushings is greater than the thickness of the bars, it will be appreciated that such branch elements may be mutually assembled in many different plane-parallel positions. Moreover, the primary and the secondary coupling means in the bushings correspond entirely to the coupling means mentioned in connection with FIG. 2, so that the branch element may be built together with the trunk element.

As appears from FIG. 3, the bars 7–11 include additional branching portions, such as the branching portions 19, 20, all of which have a bushing at the end, such as the bushings 21, 22 which substantially correspond to the portion of the coupling bushings 12–16 which serves as the coupling stud end 17. The additional branching portions are instrumental in giving the branch element greater similarity to a branch or a leaf, and the additional bushings contribute to the total impression of the leaf or the branch so that the primary and secondary coupling means are well camouflaged.

FIG. 5 schematically shows a model of a bush, built by means of the building set of the invention. The model comprises two trunk elements 23, 24 interconnected via a branch element 25. Branch elements 26, 27 are also provided at the ends of the branching portions from the trunk elements, and a pair of additional branch elements 28, 29 are secured to the branch element 26 via a building element like the one shown in FIG. 1. Additional branch elements 30, 31 are also shown.

Accordingly, it will be appreciated that the building set of the invention lends itself to building models of varied appearance regarding the shape and also with respect to whether it is to resemble a thick growth of shrubs or an open tree crown.

I claim:

1. A toy building set for building tree-like models and including elements having primary and secondary coupling means adapted for interconnection, characterized by comprising in combination a plurality of elongate trunk elements, each of which has at least a primary and secondary coupling means, respectively, in its opposed ends, at least some of said trunk elements having elongate branching portions formed with coupling means of the aforementioned type at the ends thereof, and a plurality of substantially plane branch elements, each comprising a number of integral branch bars, at least some of which have primary and secondary coupling means which are adapted to be connected with the coupling means on the trunk elements wherein the primary coupling means and the secondary coupling means of a branch element extend from a primary side and a secondary side of the plane branch element, respectively.

2. A building set according to claim 1, characterized in that at least the coupling means on the branch elements are constructed as a short bushing whose one end has an outside diameter corresponding to the inside diameter at the opposed end of the bushing.

3. A building set according to claim 1 or 2, characterized in that at least the bars of the branch elements are disposed in a plane transversely to the axes of the bushings.

4. A building set according to claim 3, characterized by additional bushings at the end of the branching portions of the branch elements, said additional bushings being disposed transversely to the plane of the branch element and constructed as the part of the coupling bushings which serves as a primary coupling means.

* * * * *